US006260493B1

(12) United States Patent
Dean

(10) Patent No.: US 6,260,493 B1
(45) Date of Patent: Jul. 17, 2001

(54) TWO PILE HEIGHT MENDING GUN

(75) Inventor: Jackie Lamar Dean, Chatsworth, GA (US)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

(21) Appl. No.: 09/773,868

(22) Filed: Feb. 1, 2001

(51) Int. Cl.[7] ..... D05C 15/06
(52) U.S. Cl. ..... 112/80.04
(58) Field of Search ..... 112/80.03, 80.04, 112/80.05, 169

(56) References Cited

U.S. PATENT DOCUMENTS 3,389,667 * 6/1968 Mueller ..... 112/80.04
5,555,826 * 9/1996 Satterfield ..... 112/80.04

FOREIGN PATENT DOCUMENTS

2621360-A * 11/1977 (DE) ..... 112/80.04
2815801-A * 10/1979 (DE) ..... 112/80.04

* cited by examiner

*Primary Examiner*—Ismael Izaguirre
(74) *Attorney, Agent, or Firm*—Alan Ruderman; Stephen J. Stark

(57) ABSTRACT

A hand-held mending gun for tufting stitches into a backing material has a hollow needle reciprocally driven axially to form stitches in a backing material. A drive mechanism couples a rotary motor to a needle carrier for reciprocation along the axis of the needle. A yarn feed roll connected to a yarn drive disk may be selectively changed in speed by changing the position of the yarn feed disk relative to a radius of a drive disk through a pneumatic cylinder having a piston relocatable between an extended and a retracted position. With the speed of rotation of the drive disk constant, the speed of the yarn feed roll may be changed between a high and a low pile height setting, or position, by changing the distance of a contact point of the yarn feed disk on the drive disk from the center of the disk drive. A pneumatic selector switch allows a single operator to control the selection of the high or low pile height position.

20 Claims, 2 Drawing Sheets

TWO PILE HEIGHT MENDING GUN

BACKGROUND OF THE INVENTION

This invention relates to a hand-held tufted carpet mender and more particularly to such a mender having the capability of selectively mending at two pile heights.

In the manufacture of tufted carpet when a defect caused by the failure of a tufting machine needle to tuft a loop into the backing material occurs, as when the needle unthreads or the strand of yarn fed to the needle is broken, the carpet is often mended by means of a hand-held mender known in the art as a mending gun.

Typically, an operator standing behind the tufting machine inspects the fabric as it leaves the tufting machine, and if a defect is sighted, a mending gun would be utilized to repair the defect. Traditional mending guns, such as those described in U.S. Pat. Nos. 4,388,881, and 5,555,826, are pneumatically powered to reciprocate a needle into and out of the tufted fabric at the location of the missing loops of yarn, and a strand of yarn is constantly fed to the needle. The operator may then "mend" the locations where the defect is located. However, these mending guns are configured to mend at a single pile height.

A number of years ago, tufting machines were configured to tuft carpet with at least two loop height levels to create a patterned rug effect. The need to provide a single mending gun with the ability to selectively mend two different pile heights was then created. Stopping to manually adjust the settings on a single traditional mending gun every time the pile height changed or requiring multiple mending guns with different pile height settings were not believed to be satisfactory solutions.

One prior art solution utilized a remote electrical control box which allowed a spotter to watch from the finished side of the carpet as an operator utilized the mending gun on the backing side. The operator would continuously mend the carpet as instructed by the spotter, while the spotter would remotely control a solenoid on the mending gun which switched the pile height setting from high to low upon the continuous depression of a switch. When the spotter released the switch, the solenoid would automatically return to the high pile height position. There was no provision for the remote electronically controlled mending gun to remain in a low-pile height tufting position without continuous depression of a switch by the second individual, i.e., the spotter, with the remote.

SUMMARY OF THE INVENTION

Consequently, it is a primary object of the present invention to provide a mending gun for tufted fabric which may repair defects at two pile heights selectively, wherein a single operator may rapidly switch between the two pile height levels without requiring a separate operator for remote operation of the mending gun.

Another object of the present invention is to allow the mending gun to remain in either a high or low pile height setting without continuous depression of a switch by an operator.

At least two advantages of the present invention are known. First, a single operator may mend two-pile height carpet since the operator now has control of the pile height level. Using a light source on the opposing side of the carpet, the light and shadows will reveal to the operator which pile height should be selected based on the amount of light transmitted through the carpet in the areas proximate to the defects. Second, the mending gun of the present invention can remain in a low-pile height setting without requiring an individual to physically maintain a switch in a depressed condition.

It is a further object of the present invention to provide a tufting mender wherein the operator may rapidly switch from a low to a high pile height setting and visa-versa. In fact, the mending gun of the present invention may be switched from high to low pile height during the mending process.

Accordingly, the present invention provides a pneumatically powered hand-held mending gun for tufting stitches into a backing material, the gun having a needle driven by a first drive mechanism to reciprocate out and in relative to the body of the gun. A control valve is utilized to position an air driven shuttle valve to one of two positions: a low and a high pile height configuration. The air driven shuttle valve operates a second drive mechanism to move a yarn feed disk via a piston across a drive disk between two locations. The yarn feed disk assists providing yarn from a yarn source to the needle of the mending gun. Since the drive disk rotates at a constant speed, the closer the yarn feed disk is to the center of the drive disk, the slower it rotates. Therefore, the lower pile height position locates the yarn feed disk closer to the center of the drive disk than the higher pile height position.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
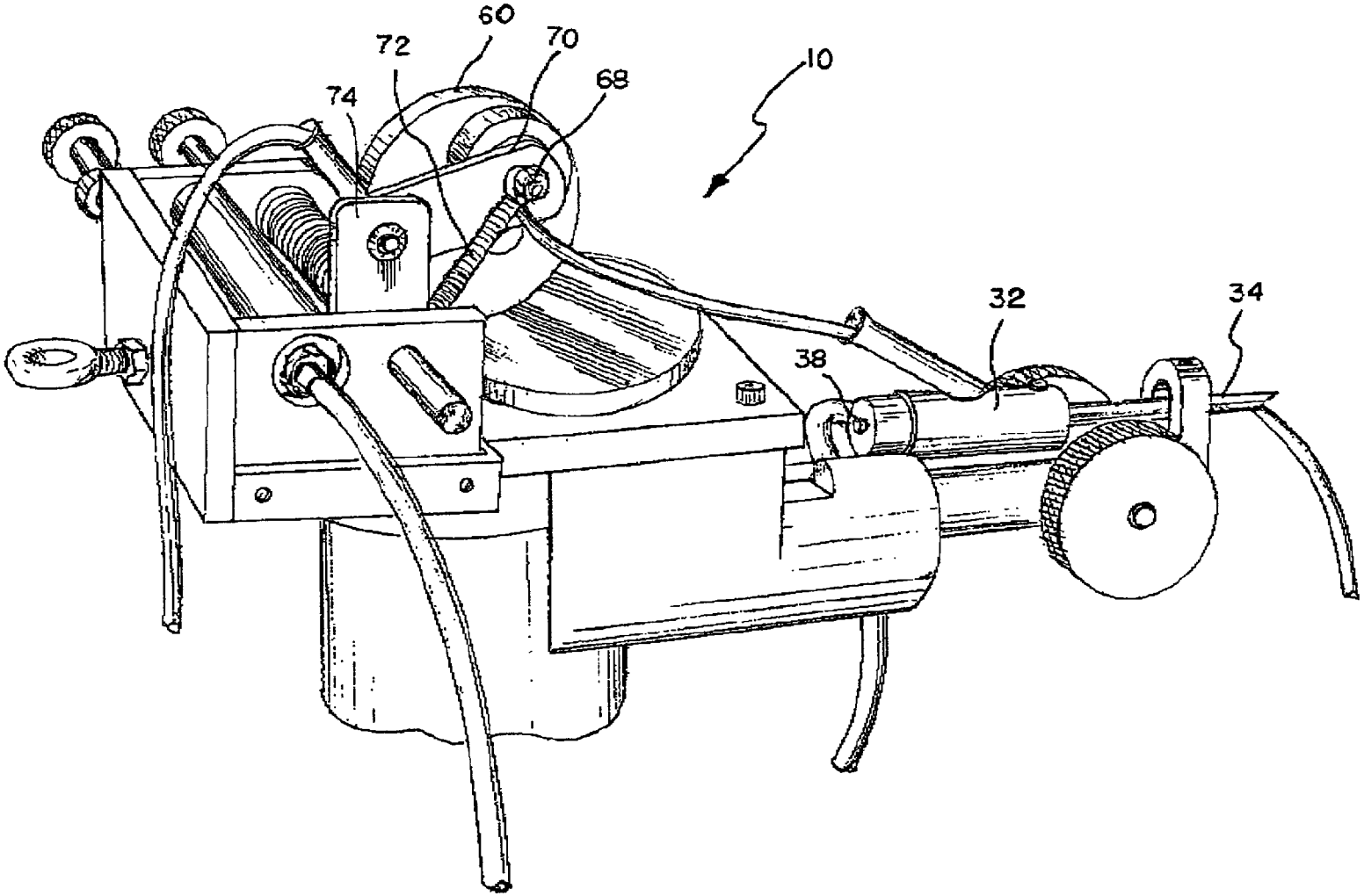
FIG. 1 is a perspective view of a hand-held mending gun constructed in accordance with the principles of the present invention.
Figure 2:
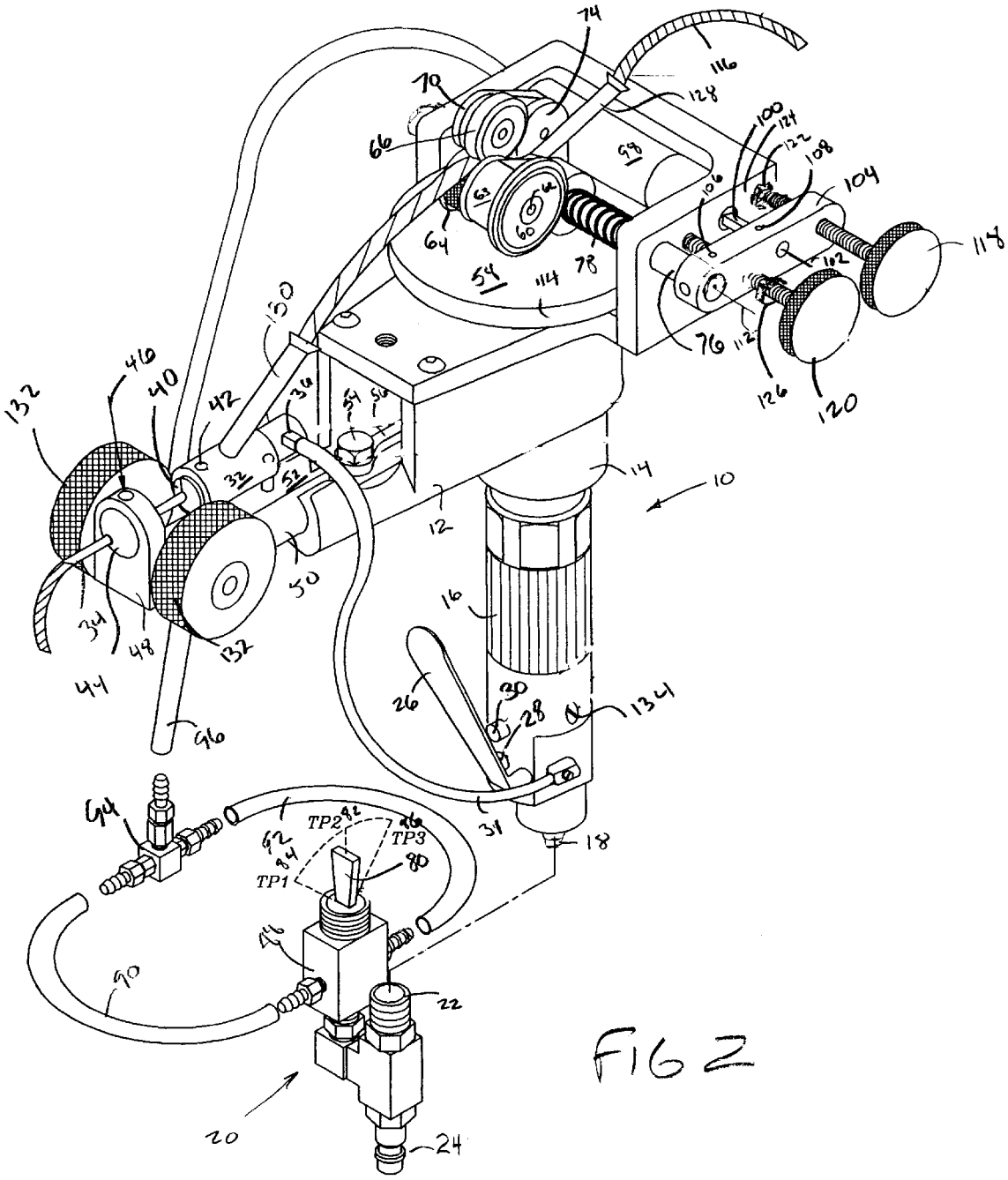
FIG. 2 is a partly disassembled exploded perspective view of the mending gun illustrated in FIG. 1.

Referring now to the drawings, FIGS. 1 and 2 illustrate a mending gun 10 having a main housing 12 including a hollow cylindrical sleeve 14 extending from the bottom thereof. Received within the sleeve is the upper end of a pneumatic rotary motor 16 having an inlet connection 18, as illustrated in FIG. 2, at the lower end adopted to be connected to the high or low pile selector 20 at selector outlet 22. The selector has an inlet 24 which may be a nipple for connecting conventionally to a source of high pressure air. One hundred psia air has been found adequate in operating the mending gun 10.

A trigger or control lever 26 may manually engaged to activate or deactivate the flow of air through conduit 31 into needle carrier 32 and through the needle 34. Air enters at the carrier inlet 36 and is directed into the carrier 32. An adjuster 38, such as a set screw, allows adjustment of the flow of air into the needle carrier 32. When the trigger or control lever 26 contacts the second activator 30, air may be directed to flow into the motor 16 and thus control the motor operation by contacting a first activator 28.

The carrier 32 is preferably equipped with a collet 40 held in place by set screw 42. The collet 40 holds the needle 34. The needle is directed through a needle guide 44 held in place by set screw 46 in the needle guide holder 48 which is connected to the housing 12 by barrel 50. A shuttle 52 connects the carrier 32 through connector 54 with arm 56. The arm 56 is connected to a disk within the housing 12 or motor 16 which allows for the translation of rotary motion to reciprocal motion in a similar fashion as described in U.S. Pat. No. 5,555,826 to provide a first drive mechanism.

The drive disk 58 is operatively connected to the motor 16, preferably in similar fashion as taught in U.S. Pat. No. 5,555,826. With the lever 26 depressed to operate the second activator 30, the motor turns to reciprocally drive the shuttle 52 and rotates the drive disk 58. The drive disk 58 contacts yarn feed disk 60. Rotation of the drive disk 58 turns the yarn feed disk 60. By adjusting the location of the yarn feed disk 60 along the radius of the drive disk 58, the speed of the yarn feed disk 60, and thus the speed of feeding yarn to the needle 34 may be adjusted as will be explained in more detail below. This provides a second drive mechanism.

The yarn feed disk 60 is equipped with an elastomeric "O" ring about its periphery and is connected by shaft 62 to yarn feed roll 64. Yarn feed support bearing 63 may remain stationary while allowing the rotation of the yarn feed roll by and yard feed disk 60. Yarn feed roll 64 may be knurled to assist in delivering yarn to the needle 34. An idle roll 66 is located proximate to the yarn feed roll 64 and is connected by axle 68 to link 70. The rolls 64 and 66 are urged into mesh with each other by a first spring 72 which is connected between the link 70 and a block 74. The block 74 is connected to rod 76. The block 74 is also preferably connected to being 63. A second spring 78 located between the block 74 and frame 124 biases the block to the "low" pile height position as illustrated in FIG. 2.

In order to move to the "high" pile position, the high or low pile selector 20 is equipped with a toggle 80 which may be triggered from the center position 82 which reflects a low pile position to a toggled position which reflects a high pile position. Movement of the toggle 80 forward (toward the needle) places the toggle 80 in a first high pile position 84 until the toggle 80 is moved back toward the center by the operator. Movement of the toggle 80 from the center backwards (toward the motor) to a second high pile position 86 also sends a "high" pile signal, but in this case the toggle 80 is biased to return toward the center position 82, unless the operator maintains the toggle 80 in this back high pile position.

With the toggle 80 moved to one of the high pile positions 84, 86, air enters through inlet 24 into the selector 20 and through the valve 88 into connectors 90, 92. A tee connector 94 connects the connects the connectors 90, 92 together and communicates through a conduit 96 to the pneumatic cylinder 98. The air then forces piston 100 outward along the axis 102 of the piston 100 from the pneumatic cylinder 98.

Both the piston 100 and the rod 76 are connected to a shoulder element 104. Set screws 106, 108 may secure the rod 76 and piston 100 to the shoulder element 104. Accordingly, movement of the shoulder element 104 by the driven piston 100 results in movement of the rod 76 to move the yarn feed disk 60 high pile height position since the yarn feed disk 60 is connected to the rod 76 by the block 74. Connector 110 (not illustrated) may be utilized to secure the block 74 to the rod 76. The yarn feed disk 60 together with the block 74 and rod 76 move along the rod axis 112 to locate the yarn feed disk 60 closer to a periphery 114 of the drive disk 58.

When the toggle 80 of the selector 80 is returned to the low pile height position 82, air is secured from flowing to the pneumatic cylinder 98 and the piston 100 returns to the low pile height position. The second spring 78 assists in returning the piston 100 to the low pile height position. In order to set the amount of yarn 116 fed to the needle 34 during the low and high pile height settings, the low and high pile adjusting screws 118,120 are utilized. The low pile height screw 118 prevents the piston 100 from returning the yarn feed disk 60 too close to the center of drive disk 58 by stopping the return of the piston 100 when the screw end 122 contacts the frame 124. The high pile height screw 120 does not move with the shoulder element 104, but has a retaining nut 126 which stops the outward travel of the shoulder element 104 to limit the travel of the piston 100 and rod 76. Accordingly, the position of the yarn feed disk 60 relative to the drive disk 58 will be limited in this manner.

To load the gun 10 with yarn 116, yarn 116 is fed through the yarn feed guide 128 and between the yarn feed roll 64 ad idle roll 70. The idle roll 70 may be moved out of the way by the operator, or the end of the yarn 116 may be placed in contact with the idle roll and yarn feed roll 64 and the motor 16 may be started to drive the yarn 116 between the yarn feel roll 64 and the idle roll 70. The yarn end is then directed through yarn guide 130 into the carriage 32. With the first activator 28 depressed by the control lever 26, air will be transmitted through the conduit 31 into the carrier 32 which will direct the yarn 116 out the end of the needle 34 for mending.

Once the gun 10 is loaded, the gun 10 may be placed proximate to the portion of carpet in need of mending. The guide rollers 132 may contact the backing material of the carpet while the needle penetrates at a desired location. The control lever 26 may then be depressed to operate the motor 16 by contacting the second activator 30 and assist in feeding yarn by contacting the first activator 28. The motor 16 speed may adjusted by a control screw 134.

When the motor 16 rotates, the needle is driven in reciprocatory motion by the carrier 32 as driven by the arm 56. Additionally, with the first activator 28 depressed, yarn is fed through the carrier 32 by the air supplied by conduit 31 through the carrier 32. The amount of yarn 116 fed to the yarn guide 130, and thus the needle 34, per stitch depends on the amount supplied from the yarn feed roll 64. Accordingly, the speed of the yarn feed disk 60 determines the amount of yarn 116 provided per loop, or stitch made during a reciprocation of the needle 34 through a backing material. As a stitch is being made, the operator moves the gun 10 along the portion to be mended. Therefore by the time the needle 34 has reciprocated back toward the housing 12 when it is no longer sticking through the backing, the movement of the gun 10 will allow the needle 34 to then penetrate at another location for the next stitch. It is preferred that the guide rollers 132 roll to assist in the continuous mending of the carpet.

Since the pneumatic motor 16 requires an air source, it has been found advantageous to utilize the same air source to allow for switching between high and low pile heights to be tufted by the mending gun 10. A single pneumatic connection, replaces the three lines required of in prior art mending guns: one pneumatic, and two electrical, one to power the solenoid and one to receive signals from the remote control. Accordingly, the preferred embodiment is an improvement over the prior art.

Having thus set forth the nature of the invention, what is claimed herein is:

1. In a hand-held mending gun having a housing, a rotary motor, a hollow needle elongated along a longitudinal axis, a needle carrier supporting said needle adapted to be driven reciprocally along said axis relative to said housing, drive means coupling said motor to said needle carrier converting rotary motion of said motor to reciprocating motion of said needle carrier to reciprocate said needle, the improvement comprising:

a pneumatically controlled cylinder, said cylinder having a piston moveable between two piston positions;

a yarn feed roll rotatable relative to an axis and driveably coupled to the piston;

a drive mechanism operatively coupling the yarn feed roll to the motor, said drive mechanism having a high and low pile height setting to rotate the yarn feed roll at two different speeds;

wherein movement of the piston between the two piston positions shifts the second drive mechanism from the high pile height setting to the low pile height setting.

2. In a hand-held mending gun as recited in claim 1, wherein the drive mechanism further comprises a yarn feed disk and a drive disk, said drive disk operatively coupled to the rotary motor, and said yarn feed disk operatively coupled to the yarn feed roll, wherein rotation of the drive disk imparts rotation to the yarn feed disk and the yard feel roll.

3. In a hand-held mending gun as recited in claim 2, wherein the yarn feed disk is connected to the yarn feed roll by an axle along the axis of the yarn feed roll.

4. In a hand-held mending gun as recited in claim 2, wherein movement of the piston locates the yarn feed disk at two locations relative to a radius of the drive disk.

5. In a hand-held mending gun as recited in claim 4, further comprising an adjustment mechanism adapted to alter a contact point where the yarn feed disk contacts the drive disk at least one of the two locations.

6. In a hand-held mending gun as recited in claim 5, wherein the adjustment mechanism is comprised of low and high pile height adjusting screws which, respectively, restrict movement of the piston to locate the yarn feed disk at the two positions.

7. In a hand-held mending gun as recited in claim 1, wherein the gun further comprises a pneumatic selector switch fixedly connected to one of the housing or motor, said selector switch having a toggle with a high and a low pile height position, said toggle adapted to stay in the high pile height position without continuous force being applied to the toggle.

8. In a hand-held mending gun as recited in claim 7, wherein the selection of the toggle to the high or low pile height positions with the selector switch selectively moves the piston between the two positions.

9. A hand-held mending gun comprising:

a rotary motor;

a needle carrier adapted to be driven in reciprocal motion;

a first drive mechanism coupling the rotary motor to the needle carrier to convert rotary motion of the motor to reciprocation of the needle carrier;

a needle supported by the needle carrier;

a circular drive disk rotated by the rotary motor;

a yarn feed disk in contact with the drive disk and relocatable between two locations relative to a radius of the drive disk;

a pneumatic cylinder having a piston with a retracted and an extended position operatively coupled to the yarn feed disk to move said yarn drive disk relative to the drive disk thereby to provide a low pile height setting and a high pile height setting as said piston is retracted and extended selectively.

10. The hand-held mending gun of claim 9 further comprising a yarn feed roll and an idle roll adapted to cooperate with the yarn feed roll to allow the feeding of yarn there between, said yarn feed roll operatively coupled to the yarn drive disk wherein rotation of the yarn drive disk imparts rotation to the yarn feed roll.

11. The hand-held mending gun of claim 10 wherein the idle roll is spring biased in position relative to the yarn feed roll.

12. The hand-held mending gun of claim 9 wherein the yarn feed disk is connected to a rod having an axis, the axis of the rod extending substantially parallel to the movement of the piston between the extended and the retracted positions, and the rod connected to the piston and adapted to move with movement of the piston between the extended and the retracted positions.

13. The hand-held mending gun of claim 12 wherein the rod is spring biased to locate the piston toward one of the extended or retracted positions and activation of the pneumatic cylinder overcomes the spring bias of the rod to move the piston to the other yarn feed disk from one of the extended or retracted positions which moves the high or low pile height settings to the other of the high or low pile height settings.

14. The hand-held mending gun of claim 12 further comprising an adjustment mechanism to allow for the precise placement of the yarn feed disk relative to the drive disk at least one of the high or low pile height positions.

15. The hand-held mending gun of claim 14 further comprising a pneumatic selector valve connected to one of the housing and motor, having a high and a low pile height positions wherein selection of the high pile height position locates the piston of the pneumatic cylinder and the yarn drive disk to the high pile height setting, and selection of the low pile height position locates the piston of the pneumatic cylinder and the yarn drive disk to the low pile height setting.

16. The hand-held mending gun of claim 15 wherein the rotary motor is pneumatically driven, and the selector valve and the rotary motor utilize a common air supply.

17. The hand-held mending gun of claim 16 wherein the selector valve has an inlet and an outlet, and wherein the motor has an air inlet and the outlet of the selector valve is connected to the inlet of the air inlet of the motor.

18. The hand-held mending gun of claim 9 wherein the needle carrier further comprises a yarn guide and an air inlet, wherein a supply of air introduced into said air inlet from an air source directs yarn provided into the guide through the needle.

19. A hand-held mending gun comprising:

a rotary motor operatively coupled to a drive disk;

a needle carrier supplied with yarn feed air to direct yarn through the needle;

a first drive mechanism connecting the rotary motor to the needle carrier converting the rotary motion of the rotary motor into reciprocatory motion of the needle carrier;

a hollow needle supported by the needle carrier;

a pneumatic cylinder adapted to receive a control air, said cylinder having a piston moveable from a retracted to an extended position with the receipt of control air;

a selector valve adapted to receive inlet air and selectively provide control air to the pneumatic cylinder; and a common air supply providing the yarn feed air and the inlet air.

20. The hand-held mending gun of claim 19 further comprising:

a yarn feed roll operatively connected to the piston wherein movement of the piston between the extended and retracted positions changes the speed of the yarn feed roll during operation of the rotary motor; and a yarn feed disk operatively coupled to the yarn feed roll, said yarn feed disk in contact with the drive disk along a periphery of the yarn feed disk, and movement of the piston between the extended and retracted positions moves the yarn feed disk from a low pile height position with the yarn feed disk located closer to a center of the drive disk to a high pile height position with the yarn feed disk located further from the center of the drive disk.

* * * * *